US009702571B2

(12) United States Patent
Yabe et al.

(10) Patent No.: US 9,702,571 B2
(45) Date of Patent: Jul. 11, 2017

(54) AIR CONDITIONER OUTDOOR UNIT

(71) Applicant: Mitsubishi Electric Corporation, Tokyo (JP)

(72) Inventors: Koji Yabe, Tokyo (JP); Naohiro Oketani, Tokyo (JP); Kazuhiko Baba, Tokyo (JP); Hiroshi Yamanaka, Tokyo (JP); Hironori Yabuuchi, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 220 days.

(21) Appl. No.: 14/405,073

(22) PCT Filed: Jun. 6, 2013

(86) PCT No.: PCT/JP2013/065695

§ 371 (c)(1),
(2) Date: Dec. 2, 2014

(87) PCT Pub. No.: WO2013/183710

PCT Pub. Date: Dec. 12, 2013

(65) Prior Publication Data

US 2015/0184871 A1 Jul. 2, 2015

(30) Foreign Application Priority Data

Jun. 7, 2012 (WO) ..... PCT/JP2012/064679

(51) Int. Cl.
*F25D 17/06* (2006.01)
*F24F 1/38* (2011.01)
(Continued)

(52) U.S. Cl.
CPC ..... *F24F 1/38* (2013.01); *F04D 25/082* (2013.01); *F24F 1/50* (2013.01)

(58) Field of Classification Search
CPC ..... F25D 23/003; F23F 1/02
(Continued)

(56) References Cited

U.S. PATENT DOCUMENTS 6,477,854 B2 11/2002 Chung et al.
7,971,448 B2 7/2011 Kim et al.
(Continued)

FOREIGN PATENT DOCUMENTS

CN 102080673 A 6/2011
CN 102272532 A 12/2011
(Continued)

OTHER PUBLICATIONS

Extended European Search Report issued Jun. 16, 2016 in the corresponding EP application No. 13800045.0.
(Continued)

*Primary Examiner* — Melvin Jones
(74) *Attorney, Agent, or Firm* — Posz Law Group, PLC

(57) ABSTRACT

To provide an air conditioner outdoor unit including a casing having an air inlet on a side surface and an air outlet on an upper surface, a heat exchanger that covers the air inlet and is provided inside the casing, a fan that sucks in air from the air inlet and discharges air from the air outlet, and a fan motor provided on a lower side of the fan. The fan motor is set such that an outer diameter D1 thereof is larger than an outer diameter D2 of a fan boss, and an outer periphery thereof is positioned on a center side of the fan motor than a straight line c passing an upper side of a center (for example, a predetermined position a) of the heat exchanger and a side (for example, a predetermined position b) of the fan boss.

36 Claims, 6 Drawing Sheets

(51) Int. Cl.
*F04D 25/08* (2006.01)
*F24F 1/50* (2011.01)

(58) Field of Classification Search
USPC ..... 62/428, 505
See application file for complete search history.

(56) References Cited

U.S. PATENT DOCUMENTS

| | | | | |
|---|---|---|---|---|
| 2003/0209024 | A1* | 11/2003 | Lee | F04D 29/281 62/262 |
| 2004/0099000 | A1* | 5/2004 | Jung | F04D 29/545 62/285 |
| 2010/0175407 | A1 | 7/2010 | Kim et al. | |
| 2011/0127019 | A1 | 6/2011 | Abastari et al. | |

FOREIGN PATENT DOCUMENTS

| | | | |
|---|---|---|---|
| EP | 2206976 | A2 | 7/2010 |
| EP | 2333435 | A2 | 6/2011 |
| JP | S58-78468 | U | 5/1983 |
| JP | S58-174664 | U | 11/1983 |
| JP | H06-147553 | A | 5/1994 |
| JP | H07-180862 | A | 7/1995 |
| JP | H09-137970 | A | 5/1997 |
| JP | H11-201506 | A | 7/1999 |
| JP | 2002-81697 | A | 3/2002 |
| JP | 2005-69124 | A | 3/2005 |
| JP | 2005-229671 | A | 8/2005 |
| JP | 2006-353051 | A | 12/2006 |
| JP | 2007-147207 | A | 6/2007 |
| JP | 2008-178165 | A | 7/2008 |
| JP | 2011-102662 | A | 5/2011 |

OTHER PUBLICATIONS

Chinese Office Action mailed on Jul. 11, 2016 in the corresponding CN application No. 201380029779.3 ( English translation attached).
Office Action mailed Jul. 7, 2015 issued in corresponding JP patent application No. 2014-520044 (and English translation).
International Search Report of the International Searching Authority mailed Sep. 10, 2013 for the corresponding international application No. PCT/JP2013/065695 (and English translation).
Office Action mailed on Mar. 2, 2017 issued in the corresponding EP application No. 13 800 045.0.
Office Action mailed on Feb. 8, 2017 issued in the corresponding CN application No. 201380029779.3 (and partial English translation).

* cited by examiner

AIR CONDITIONER OUTDOOR UNIT

CROSS REFERENCE TO RELATED APPLICATION

This application is a U.S. national stage application of International Patent Application No. PCT/JP2013/065695 filed on Jun. 6, 2013, and is based on International Patent Application No. PCT/JP2012/064679 filed on Jun. 7, 2012, the contents of which are incorporated herein by reference.

TECHNICAL FIELD

The present invention relates to a top flow-type air conditioner outdoor unit.

BACKGROUND

A multi air conditioner has been widely used as means for air-conditioning a plurality of spaces in large-scale premises such as a building. In multi air conditioners, each of outdoor units is closely arranged in order to reduce the entire installation area of a plurality of outdoor units. For an outdoor unit of a multi air conditioner, a top-flow structure in which air sucked in from the side of the outdoor unit is blown out from an upper part of the outdoor unit has been frequently adopted so that a required operation can be performed even under such installation environment. A top-flow type outdoor unit includes a heat exchanger provided on side surfaces of the outdoor unit, an air inlet provided on side surfaces of a casing of the outdoor unit so that air is introduced to the heat exchanger, an air outlet provided on an upper surface of the casing of the outdoor unit, a fan for taking in air present on the side of the outdoor unit towards inside of the outdoor unit and discharging air to outside of the outdoor unit from the air outlet, and a fan motor provided between the heat exchanger and the fan to drive the fan. The fan is rotated by transmitting a drive force of the fan motor to a fan boss provided at the center portion of blades (for example, Patent Literature 1).

In the outdoor unit configured in this manner, when a compressor provided in the outdoor unit is operated, a refrigerant is circulated into the heat exchanger, to perform heat exchange between ambient air of the heat exchanger and the refrigerant. When the fan is rotated, air is taken in to the inside of the outdoor unit from the sides of the outdoor unit, and a wind caused at this time is introduced into the heat exchanger, thereby facilitating heat exchange.

PATENT LITERATURE

Patent Literature 1: Japanese Patent Application Laid-open No. 2011-102662 (FIG. 1 and the like)

Regarding the motor, as the outer diameter thereof becomes larger, the ratio of an iron loss (such as a hysteresis loss occurring in a stator) to a copper loss (a loss caused by an electric current flowing to a winding wire) decreases and the loss decreases, thereby enabling to improve the motor efficiency. Therefore, it is desired to increase the outer diameter also in a fan motor used in the top flow-type outdoor unit. However, in conventional techniques represented by Patent Literature 1 mentioned above, the outer diameter of the fan motor is generally designed to be smaller than that of the fan boss, taking into consideration the influence of blockage of an air passage by the fan motor at the time when a wind taken into the outdoor unit via the heat exchanger is discharged from the air outlet. The influence means a decrease of a heat exchange amount due to a decrease of air flow of the wind flowing through the heat exchanger. Particularly, in the conventional techniques, the outer diameter of the motor is, in many cases, designed to be slightly smaller than the outer diameter of the fan boss, taking a manufacturing error of the fan motor into consideration. Further, in the conventional techniques, the outer diameter of the motor is, in many cases, designed to be smaller than the outer diameter of the fan boss, taking into consideration the influence on the air passage due to an installation error of the fan motor. In this manner, improvement of the heat exchange amount and improvement of the motor efficiency in the heat exchanger have a tradeoff relation, and the conventional techniques have a problem that the motor efficiency cannot be improved without decreasing the heat exchange amount.

SUMMARY

The present invention has been achieved in view of the above problems, and an object of the present invention is to provide an air conditioner outdoor unit that can improve the motor efficiency without decreasing the heat exchange amount.

In order to solve the aforementioned problems, an air conditioner outdoor unit according to one aspect of the present invention includes: a casing having an air inlet on a side surface and an air outlet on an upper surface; a heat exchanger that covers the air inlet and is provided inside the casing; a fan that sucks in air from the air inlet and discharges air from the air outlet; and a fan motor provided on a lower side of the fan, wherein when an outer diameter of the fan motor is D1, an outer diameter of a boss of the fan is D2, an external dimension of one side of the casing is A, an external dimension of the other side orthogonal to the one side of the casing is B, an internal dimension of one side of the heat exchanger is a, and an internal dimension of the other side orthogonal to the one side of the heat exchanger is b, the fan motor is formed so as to satisfy $D2 \leq D1$, and also satisfy $(D1)^2\pi/4 < A \times B \times 0.12$ or $(D1)^2\pi/4 < a \times b \times 0.2$.

According to the present invention, the outer diameter of the fan motor is set to a size in which the ratio of an iron loss to a copper loss is decreased, yet with a little influence on the wind passage. Accordingly, the motor efficiency can be improved without decreasing the heat exchange amount.

DETAILED DESCRIPTION

Exemplary embodiments of an air conditioner outdoor unit according to the present invention will be explained below in detail with reference to the accompanying drawings. The present invention is not limited to the embodiments.

Embodiment

Figure 1:
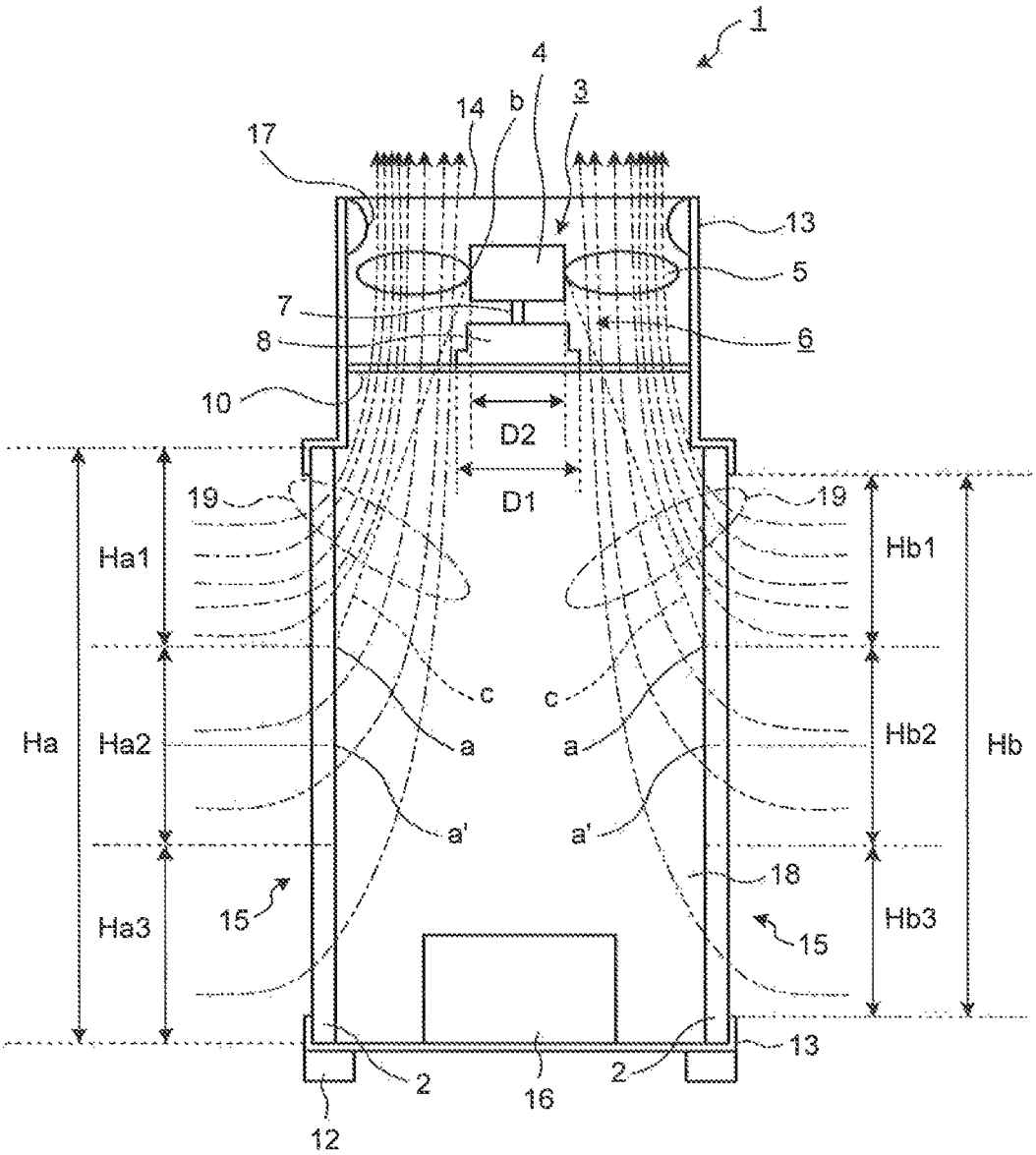
FIG. 1 is a longitudinal sectional view of an air conditioner outdoor unit according to an embodiment of the present invention.
Figure 2:
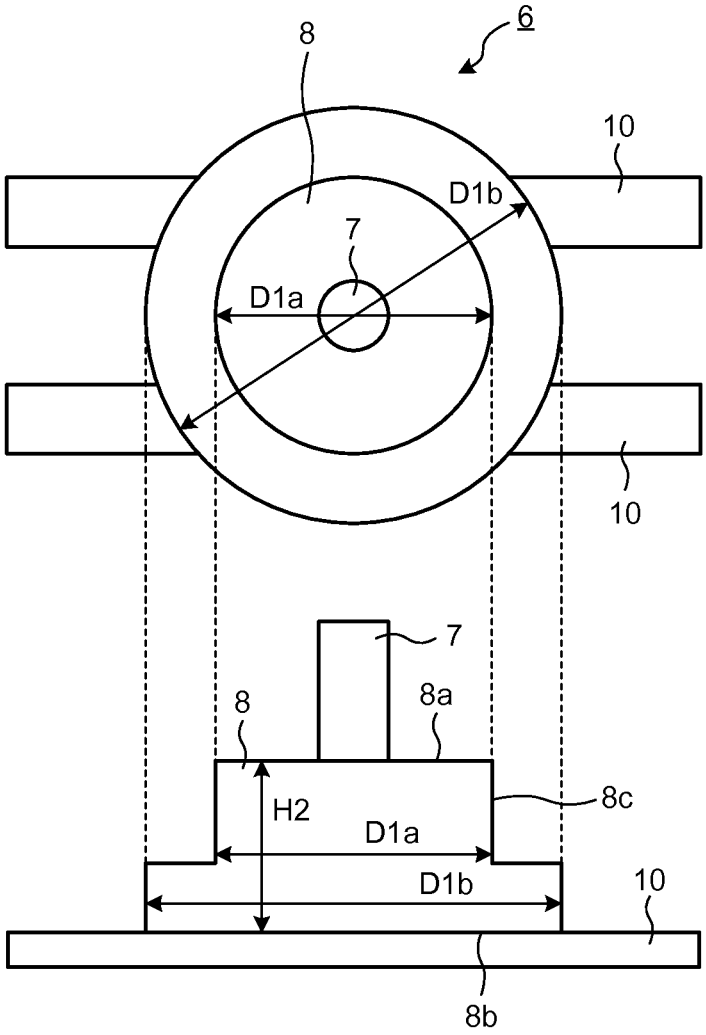
FIG. 2 is a configuration diagram of a fan motor shown in FIG. 1.
Figure 3:
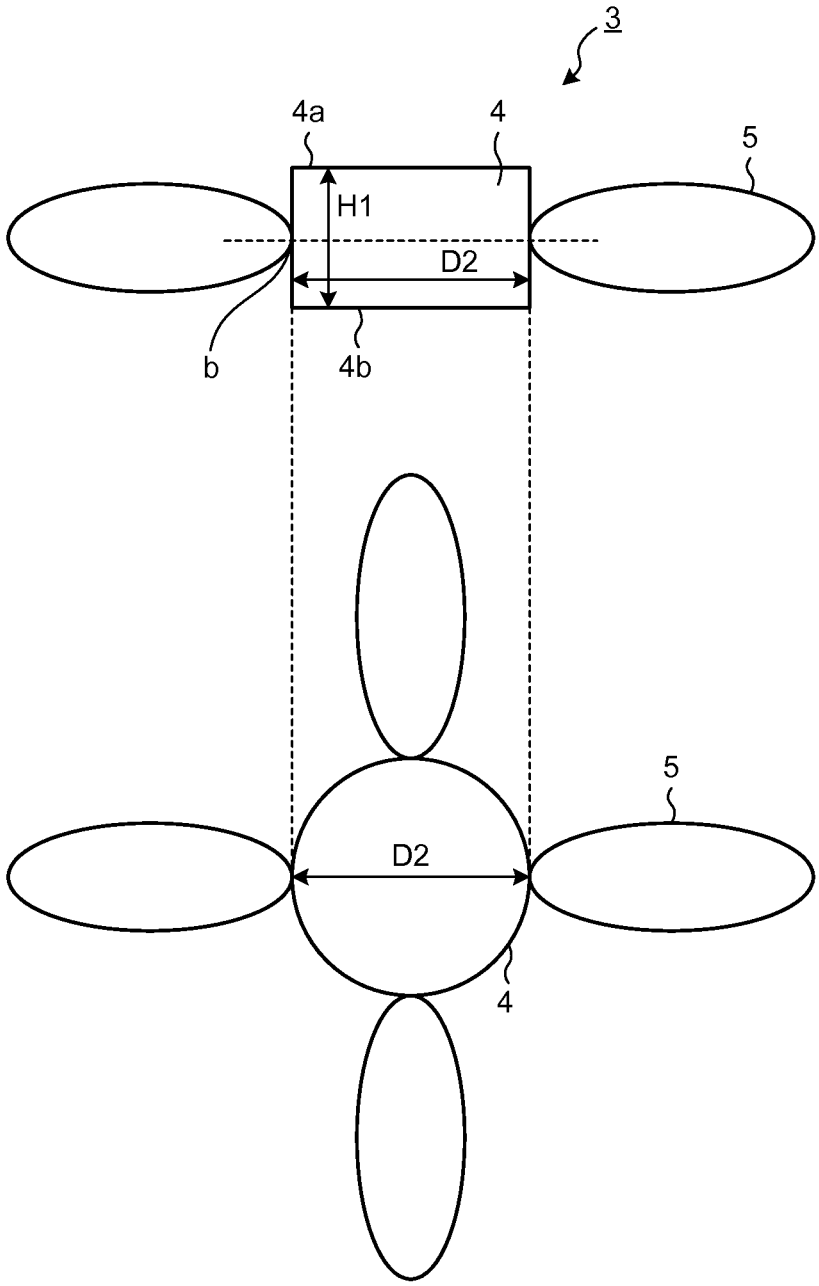
FIG. 3 is a configuration diagram of a fan shown in FIG. 1.

FIG. 1 is a longitudinal sectional view of an air conditioner outdoor unit (hereinafter, "outdoor unit") 1 according to an embodiment of the present invention. FIG. 2 is a configuration diagram of a fan motor 6 shown in FIG. 1. FIG. 3 is a configuration diagram of a fan 3 shown in FIG. 1.

The outdoor unit 1 includes a heat exchanger 2 provided on side surfaces of a casing 13, an air inlet 15 provided on the side surfaces of the casing 13 for leading air into the heat exchanger 2, an air outlet 14 for discharging air conducted into the heat exchanger 2 to an upper part of the outdoor unit, a fan 3 that takes in air on the side of the outdoor unit into the outdoor unit and discharges air to the outside of the outdoor unit from the air outlet 14, and the fan motor 6 set between the heat exchanger 2 and the fan 3 to rotate the fan 3.

The casing 13 is supported by support legs 12, and the fan motor 6 is installed on the upper side inside the casing 13 by fitting legs 10 which are fixing members. An electrical product 16 is provided inside the casing 13. The electrical product 16 is, for example, a control board that controls a compressor for increasing the pressure of a refrigerant and controls activation of the compressor and the fan motor 6. The electrical product 16 is separated from a blast room 18 by a partition board (not shown), and forms a rainproof structure to withstand exposure to rain. A bell mouth 17 that reduces pressure losses at the time of discharging a wind 19 having passed through the heat exchanger 2 and flowed into the blast room 18 is provided between the air outlet 14 and the fan 3.

The fan motor 6 is configured to include a motor body 8 and a shaft 7, which is an output shaft of the fan motor 6, as a main configuration. The motor body 8 is configured to include a frame 8*c* including a rotor and a stator therein, an axially outer end face 8*a* provided on the side of the shaft 7 (on the side of the air outlet 14) of the frame 8*c*, and an axially inner end face 8*b* provided on the opposite side to the shaft 7 (on the side of the fitting leg 10) of the frame 8*c*.

The upper configuration diagram in FIG. 2 shows an exterior appearance of the fan motor 6 as viewed from the side of the fan 3, and the lower diagram in FIG. 2 shows an exterior appearance of the fan motor 6 as viewed from the side. The motor body 8 shown in FIG. 2 is formed, as an example, such that an outer diameter of the frame 8*c* is decreased as going from the axially inner end face 8*b* toward the axially outer end face 8*a*. For example, an outer diameter D1*a* on the side of the axially outer end face 8*a* becomes smaller than an outer diameter D1*b* of the axially inner end face 8*b*. The shape of the motor body 8 is not limited thereto, and the motor body 8 can be formed such that the outer diameters D1*a* and D1*b* are the same, or the outer diameter D1*a* is formed larger than the outer diameter D1*b*. In the following explanations, the diameter of the frame 8*c* is simply referred to as "outer diameter D1", unless particular reference thereto is made. For example, the outer diameter D1 is an outer diameter in a state where a coil (not shown) of the fan motor 6 has been molded by an insulating resin.

The fan motor 6 is configured such that a relation between the outer diameter D1 and the height H2 is, for example, D1>H2. With this configuration, the fan motor 6 has a flattened structure having a short side in the axial direction. Motor losses during the time of a rated operation include a copper loss and an iron loss. However, by the flattened structure, the ratio of the iron loss to the copper loss is made small, thereby enabling to improve the motor efficiency. Because the fan motor 6 is configured in such a manner that the relation between the copper loss and the iron loss is "copper loss >iron loss", high efficiency can be realized. When the fan motor 6 is formed in a flattened structure in which the relation between the copper loss and the iron loss is "copper loss >2×iron loss", higher efficiency can be realized.

As in the fan motor 6 according to the present embodiment, when the motor has such a shape that there is a difference in level on an outer periphery of the frame 8*c* (or the outer periphery inclines), and the diameter decreases in the axial direction, the widest portion in the radial direction (the direction orthogonal to the axial direction of the shaft 7) of the outer periphery of the fan motor 6 is the outer diameter D1. For example, when the fan motor 6 is of an inner rotor type in which a rotor is present inside the stator, the diameter of the frame 8*c* provided on the outer circumference of the stator is the outer diameter D1. When the fan motor 6 is of an outer rotor type in which the rotor is present outside the stator, the diameter of the frame 8*c* provided on the outer circumference of the rotor is the outer diameter D1.

The upper diagram in FIG. 3 shows an exterior appearance of the fan 3 as viewed from the side, and the lower diagram in FIG. 3 shows an exterior appearance of the fan 3 as viewed from the side of the fan motor 6. The fan 3 is configured to include blades 5 such as propeller fans or mixed-flow fans, and a fan boss 4 formed in an annular shape and installed on the shaft 7 to hold the blades 5. As an example, the fan boss 4 shown in FIG. 3 is formed such that the outer diameter of the axially outer end face 4*a* and the outer diameter of the axially inner end face 4*b* are the same, and the diameter of the fan boss 4 is referred to as "outer diameter D2" in the following explanations.

In the outdoor unit 1 according to the present embodiment, a lower limit and an upper limit of the outer diameter D1 of the fan motor 6 are set as described below. Specifically, when each dimension obtained by trisecting a dimension Ha (Ha×⅓) in the height direction of the heat exchanger 2 (see FIG. 1) is Ha1, Ha2, and Ha3 in the order from the top, the position on the heat exchanger 2 away from the upper end of the heat exchanger 2 by a length corresponding to Ha×⅓ (Ha1) is a "predetermined position a" in FIG. 1. Further, the position obtained by bisecting a dimension H1 in the height direction of the fan boss 4 (see FIG. 3), that is, the position on the fan boss 4 away from the end face (4*a* or 4*b*) of the fan boss 4 by a length corresponding to H1×½ is a "predetermined position b" (see FIGS. 1 and 3). When there is an irregularity such as a recess or a protrusion on the axially outer end face 4*a* or the axially inner end face 4*b* of the fan boss 4, the end of the irregularity is regarded as being the base for the height of the fan 3 (H1).

A dotted straight line c shown in FIG. 1 expresses a line passing the predetermined position a and the predetermined position b. The fan motor 6 according to the present embodiment is set such that the dimension of the outer diameter D1 is larger than the outer diameter D2 of the fan boss 4 and the outer periphery of the frame 8*c* is positioned closer to the center side of the fan motor than the straight line c.

The reason why the fan motor 6 according to the present embodiment is configured in this manner is explained below. Regarding the fan motor 6, the outer diameter D1 can be reduced by using, for example, the frame 8*c* having a long cylindrical shape. However, as the outer diameter D1 decreases, the ratio of the iron loss to the copper loss increases. Therefore, the motor loss is increased to thereby decrease the motor efficiency. Accordingly, by increasing the outer diameter D1, the motor efficiency can be improved.

However, regarding the top flow-type outdoor unit 1, because the fan motor 6 is provided between the heat exchanger 2 and the air outlet 14, when the outer diameter D1 is increased more than necessary, the air passage for the wind 19 is blocked by the fan motor 6 (particularly, by the outer periphery of the fan motor 6). In this case, the air flow of the wind 19 flowing in the heat exchanger 2 decreases, thereby decreasing the heat exchange efficiency. In the conventional techniques, it is designed such that the outer diameter D1 of the fan motor 6 becomes smaller than the outer diameter D2 of the fan boss 4, in order to prevent a decrease in the heat exchange efficiency. Particularly, in the conventional techniques, the fan motor 6 is configured to have the outer diameter D1 equal to or smaller than 95% of the outer diameter D2, taking the manufacturing error of the fan motor 6 into consideration. Further, in the conventional techniques, it is designed such that the outer diameter D1 becomes smaller than the outer diameter D2, taking into consideration the influence on the wind 19 due to an installation error of the fan motor 6.

In FIG. 1 of Patent Literature 1 mentioned above, a fan motor having a larger outer diameter than the outer diameter of the boss is shown. This is because constituent elements of the outdoor unit are shown schematically and not in actual dimensions. In the conventional techniques represented by Patent Literature 1 mentioned above, the outer diameter D1 of the fan motor 6 is generally formed to be equal to or smaller than the outer diameter D2 of the fan boss 4. Therefore, the conventional techniques cannot meet the needs for improving the motor efficiency without reducing the heat exchange amount.

On the other hand, in the top flow-type outdoor unit 1, the fan 3 is provided on the upper side of the heat exchanger 2, to take in air to the blast room 18 from the sides of the outdoor unit 1 by utilizing a negative pressure caused by the rotation of the fan 3, and the wind 19 taken into the blast room 18 is guided to the air outlet 14 and discharged to the outside. Therefore, in the top flow-type outdoor unit 1, the negative pressure caused by the rotation of the fan 3 acts most strongly on the upper part of the heat exchanger 2 positioned near the fan 3. Accordingly, the wind 19 passing through the heat exchanger 2 has such a tendency that the wind 19 becomes the strongest in the upper part of the heat exchanger 2 and becomes weaker as going toward the lower side of the heat exchanger 2 (as moving away from the fan 3).

FIG. 1 schematically shows the flow of the wind 19 passing through the heat exchanger 2. Because the negative pressure caused by the rotation of the fan 3 acts most strongly on the upper part of the heat exchanger 2 (a portion indicated by reference sign Ha1), the wind 19 in the upper part of the heat exchanger 2 is stronger than in the middle part (a portion indicated by reference sign Ha2) or in the lower part (a portion indicated by reference sign Ha3) of the heat exchanger 2. The wind 19 having passed through the heat exchanger 2 flows over the shortest distance between the heat exchanger 2 and the air outlet 14. Therefore, the wind 19 having passed through the upper part of the heat exchanger 2 flows near the inner periphery of the casing 13 (a position away from the fan motor 6), and is discharged from the air outlet 14. Although a part of the wind 19 having passed through the heat exchanger 2 (for example, the wind 19 having passed through the middle part and the lower part of the heat exchanger 2) passes near the fan motor 6, the wind 19 having passed through the upper part of the heat exchanger 2 is dominant as the intensity of the wind 19. Therefore, when the outer diameter D1 of the fan motor 6 is set to a size not disturbing the flow of the wind 19 having passed through the upper part of the heat exchanger 2, the motor efficiency can be improved without causing any influence on the air passage, that is, a decrease in the heat exchange efficiency.

In the present embodiment, therefore, the straight line c is used as a base for the upper limit of the outer diameter D1 that does not disturb the air passage of the wind 19 having passed through the upper part of the heat exchanger 2. That is, the fan motor 6 according to the present embodiment is formed such that the dimension of the outer diameter D1 is larger than the outer diameter D2 of the fan boss 4, and the outer periphery of the frame 8*c* is positioned inside of the straight line c.

Operations of the present embodiment are explained below. When a compressor needs to be operated due to the relation between a set temperature of an indoor unit (not shown) and a room temperature, drive control of the compressor is executed by the control board in the electrical product 16, and the refrigerant circulates in the heat exchanger 2 by starting the operation of the compressor, to perform heat exchange between ambient air of the heat exchanger 2 and the refrigerant. The drive control of the fan motor 6 is also executed by the control board, and a negative pressure is generated due to the rotation of the fan 3 attached to the fan motor 6, and air around the sides of the outdoor unit 1 is taken in to the blast room 18. The wind 19 caused at this time is introduced into the heat exchanger 2, thereby facilitating heat exchange. Because the outer periphery of the fan motor 6 is positioned closer to the center side of the outdoor unit 1 (an axis side) than the straight line c, the air passage of the wind 19 taken into the blast room 18 is not affected by the fan motor 6. The wind 19 passes between the casing 13 and the fan motor 6 and is discharged from the air outlet 14.

When the manufacturing error of the fan motor 6 is taken into consideration, for example, the outer diameter D1 only needs to be set larger than a value corresponding to 95% of the outer diameter D2 and to be positioned closer to the center side of the fan motor fan the straight line c.

In the present embodiment, it has been explained that the predetermined position a is the position of the heat exchanger 2 away from the upper end of the heat exchanger 2 by a length corresponding to Ha×⅓. However, the predetermined position a is not limited thereto. The wind having passed through the upper part of the heat exchanger 2 is dominant in the intensity of the wind 19 led to the heat exchanger 2 rather than the wind having passed through the lower part of the heat exchanger 2. Therefore, for example, a position a' on the heat exchanger 2 away from the upper end of the heat exchanger 2 by a length corresponding to Ha×½ can be used as the "predetermined position a". When the position a' is used as the "predetermined position a", although the largest value of the outer diameter D1 of the fan motor 6 becomes slightly smaller, the motor efficiency can be improved. That is, it is assumed that the fan motor 6 according to the present embodiment is formed such that the dimension of the outer diameter D1 is larger than the outer diameter D2 of the fan boss 4, and the outer periphery of the frame 8*c* is positioned inside of the straight line c passing the predetermined position b and the upper side of the height center of the heat exchanger 2 (the predetermined position a, a').

In the present embodiment, it has been explained that the predetermined position a is the position on the heat exchanger 2 away from the upper end of the heat exchanger 2 by the length corresponding to Ha×⅓. However, the predetermined position a can be a position described below. That is, when each dimension obtained by trisecting a dimension Hb (Hb×⅓) in the height direction of the air inlet 15 (see FIG. 1) is Hb1, Hb2, and Hb3 in the order from the top, the position on the heat exchanger 2 away from the upper end of the air inlet 15 by a length corresponding to Hb×⅓ (Hb1) becomes the "predetermined position a" in FIG. 1.

In the present embodiment, the position on the fan boss 4 away from the end face (4*a* or 4*b*) of the fan boss 4 by a length corresponding to H1×½ is explained as the predetermined position b, for convenience sake. However, the predetermined position b is not limited thereto, and can be an arbitrary position on the side surface of the fan boss 4.

A motor structure suitable for the fan motor 6 according to the present embodiment includes an inner-rotor type, an outer-rotor type, a double-rotor type in which rotors are present inside and outside of a stator, and an axial gap type in which a rotor and a stator face each other in a parallel direction with respect to the rotation axis. In the present embodiment, because it is the object to improve the motor efficiency by increasing the outer diameter D1 of the fan motor 6, the motor efficiency can be improved when the relation between the copper loss and the iron loss becomes "copper loss >iron loss". Therefore, the present embodiment can be applied to any motor structure described above.

The inner-rotor type can enlarge a winding area by increasing the outer diameter D1, and can improve the motor efficiency effectively. Particularly, the fan motor 6 according to the present embodiment is suitable for a flattened structure, and thus the inner-rotor type is better suited for a combination with the present embodiment. In the-outer rotor type, because the rotor is present outside and the stator is present inside, an area of the central part can be efficiently used. Therefore, the outer-rotor type is suitable for a flattened structure and better suited for a combination with the present embodiment. In the double-rotor type, the rotors are present inside and outside of the stator. Therefore, the double-rotor type is suitable for a flattened structure, and better suited for a combination with the present embodiment. Accordingly, by applying a motor of the inner-rotor type, the outer-rotor type, or of the double-rotor type to the fan motor 6 according to the present embodiment, the outdoor unit 1 with higher efficiency can be acquired.

Figure 4:
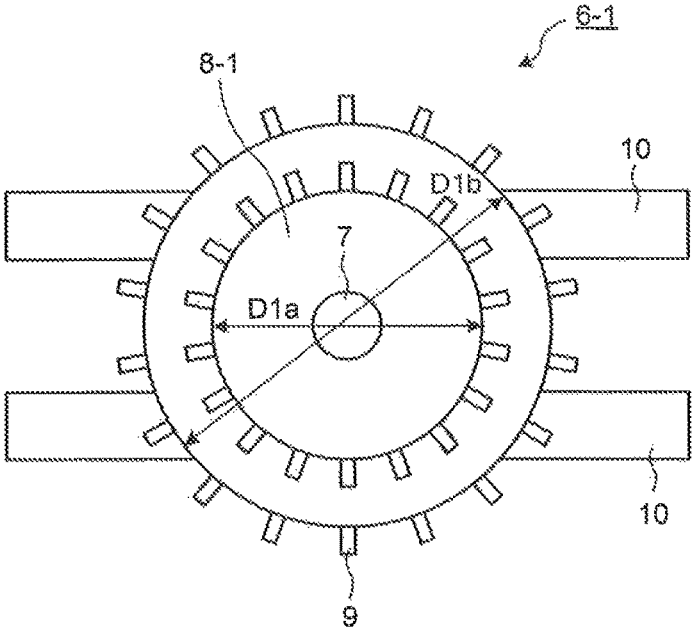
FIG. 4 shows a modification of a fan motor.

FIG. 4 shows a modification of the fan motor 6. A fan motor 6-1 shown in FIG. 4 is provided with fins (heat dissipators 9) for improving the cooling performance. The heat dissipators 9 are for improving the cooling performance by increasing the surface area of a motor body 8-1, and are arranged in the circumferential direction on the outer periphery of the motor with predetermined intervals, and thus the influence on the wind passage is small. Therefore, in the fan motor 6-1 provided with the heat dissipators 9, a part excluding the heat dissipators 9 becomes the outer diameter D1 (D1*a* or D1*b*), and it is set such that the dimension of the outer diameter D1 is larger than the outer diameter D2 of the fan boss 4, and the outer periphery of the frame 8*c* is positioned closer to the center side of the motor than the straight line c.

Figure 5:
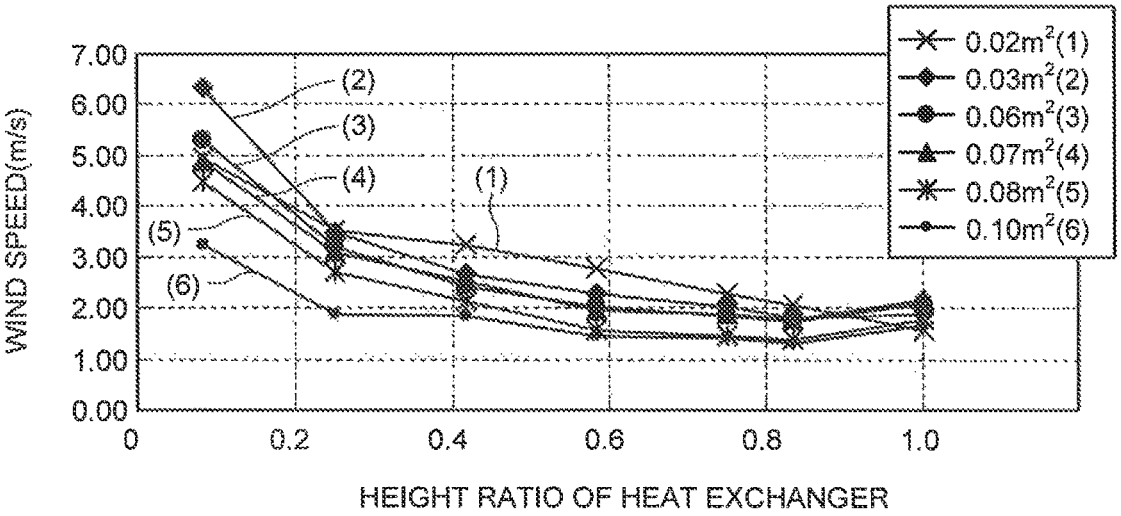
FIG. 5 shows a relation between a position in a height direction and a wind speed in a casing.

FIG. 5 shows a relation between the position in the height direction and the wind speed in the casing. A value obtained by standardizing a measurement position at the time of performing measurement from the upper end position of the heat exchanger 2 (a position at a height Ha) as a reference in the direction toward the lower part by the height Ha of the heat exchanger 2 (a standardized measurement position) is plotted on the abscissa, and the wind speed of a wind conducted to the heat exchanger 2 is plotted on the ordinate. In FIG. 5, the relation between the standardized measurement position and the wind speed in the outdoor unit 1 that uses the fan motor 6 having a different dimensions of the outer diameter D1 is shown as an example.

Figure 6:
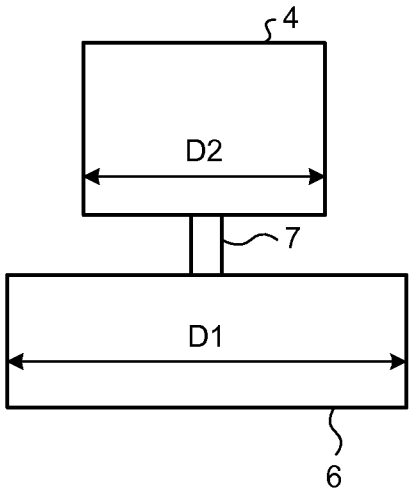
FIG. 6 is an explanatory diagram a relation between an outer diameter of a fan boss and an outer diameter of a fan motor.
Figure 7:
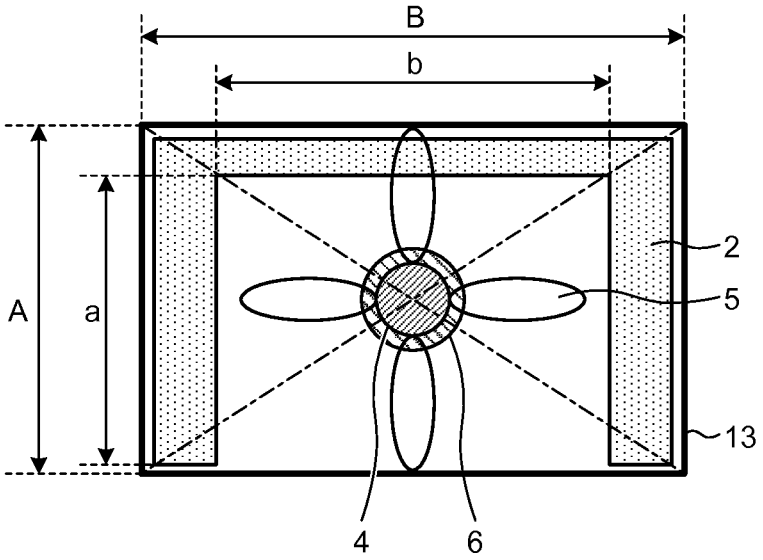
FIG. 7 is an explanatory diagram of a relation between a cross-sectional area of an inside of a casing or a heat exchanger and a cross-sectional area of a fan motor.

FIG. 6 is an explanatory diagram of a relation between the outer diameter of the fan boss and the outer diameter of the fan motor, and shows a relation between the outer diameter D1 of the fan motor 6 and the outer diameter D2 of the fan boss 4. FIG. 7 is an explanatory diagram of the relation between a sectional area of the inside of the casing or the heat exchanger and a sectional area of the fan motor, and shows the casing 13, the heat exchanger 2, the fan boss 4, and the fan motor 6 when the inside of the casing 13 is viewed from above.

A curved line (1) in FIG. 5 indicates data when the fan motor 6 having an effective sectional area of 0.02 $m^2$ is used. Similarly, curved lines (2) to (6) indicate data when the fan motors 6 respectively having an effective sectional area of 0.03 $m^2$, 0.06 $m^2$, 0.07 $m^2$, 0.08 $m^2$, and 0.10 $m^2$ are used.

Focusing on the leftmost data in FIG. 5, the wind speed when the fan motor 6 of (1) is used is about 4.9 m/s, the wind speed when the fan motor 6 of (2) is used is about 6.3 m/s, the wind speed when the fan motor 6 of (3) is used is about 5.2 m/s, the wind speed when the fan motor 6 of (4) is used is about 4.9 m/s, and the wind speed when the fan motor 6 of (5) is used is about 4.4 m/s.

The data shown in FIG. 5 is an example when an external dimension A of one side of the casing 13 (an external dimension in the short direction) is 760 millimeters, and an external dimension B of the other side orthogonal to the one side of the casing 13 (an external dimension in the longitudinal direction) is 920 millimeters, an internal dimension a of one side of the heat exchanger 2 is 520 millimeters, and an internal dimension b of the other side orthogonal to the one side of the heat exchanger 2 is 861 millimeters. When the casing 13 and the heat exchanger 2 having such dimensions are used, it is desirable to ensure the wind speed equal to or higher than 4.0 m/s at the leftmost measurement position in FIG. 5. On the other hand, the wind speed at the same measurement position when the fan motor 6 of (6) is used has decreased to about 3.2 m/s, and thus the fan motor 6 is hardly a preferable fan motor.

The condition of being equal to or higher than 4.0 m/s can be specified by a parameter expressing the dimensions of the heat exchanger 2, the fan motor 6, and the casing 13. Specifically, the condition can be expressed by the following Expressions by using the external dimension D1 of the fan motor 6, the outer diameter D2 of the fan boss 4, the external dimension A of the one side of the casing 13, the external dimension B of the other side of the casing 13, the internal dimension a of the one side of the heat exchanger 2, and the internal dimension b of the other side of the heat exchanger 2.

$$D2 \leq D1 \quad (1)$$

$$(D1)^2 \times \pi/4 < A \times B \times 0.12 \quad (2)$$

$$(D1)^2 \times \pi/4 < a \times b \times 0.2 \quad (3)$$

Expression (1) is a conditional expression relating to the lower limit of the outer diameter D1 of the fan motor 6, and expressions (2) and (3) are conditional expressions relating to the upper limit of the outer diameter D1 of the fan motor 6.

Whereas in Expression (2), the upper limit of D1 is specified based on the external dimension of the casing 13, in Expression (3), the upper limit of D1 is specified based on the internal dimension of the heat exchanger 2, and only either one of the Conditional Expressions is needed to be established.

The grounds of the numerical value on the right side of the Conditional Expression (2) are explained next. In FIG. 5, when the cross-sectional area with the wind speed of 4.0 m/s is obtained by interpolation based on the wind speed 3.2 m/s when the fan motor 6 of (6) is used (the effective sectional area 0.10 $m^2$) and the wind speed 4.4 m/s when the fan motor 6 of (5) is used (the effective sectional area 0.08 $m^2$), the cross-sectional area becomes about 0.088 $m^2$. When the value of 0.088 $m^2$ is obtained as the ratio to a product of the external dimension A=760 millimeters and the external dimension B=920 millimeters of the casing 13, it becomes $0.088/(0.76 \times 0.92) \cong 0.12$.

Similarly, when the cross-sectional area 0.088 $m^2$ with the wind speed of 4.0 m/s is obtained as the ratio to a product of the internal dimension a=520 millimeters and the internal dimension b=861 millimeters of the heat exchanger 2, it becomes $0.088/(0.52 \times 0.861) \cong 0.20$.

Figure 8:
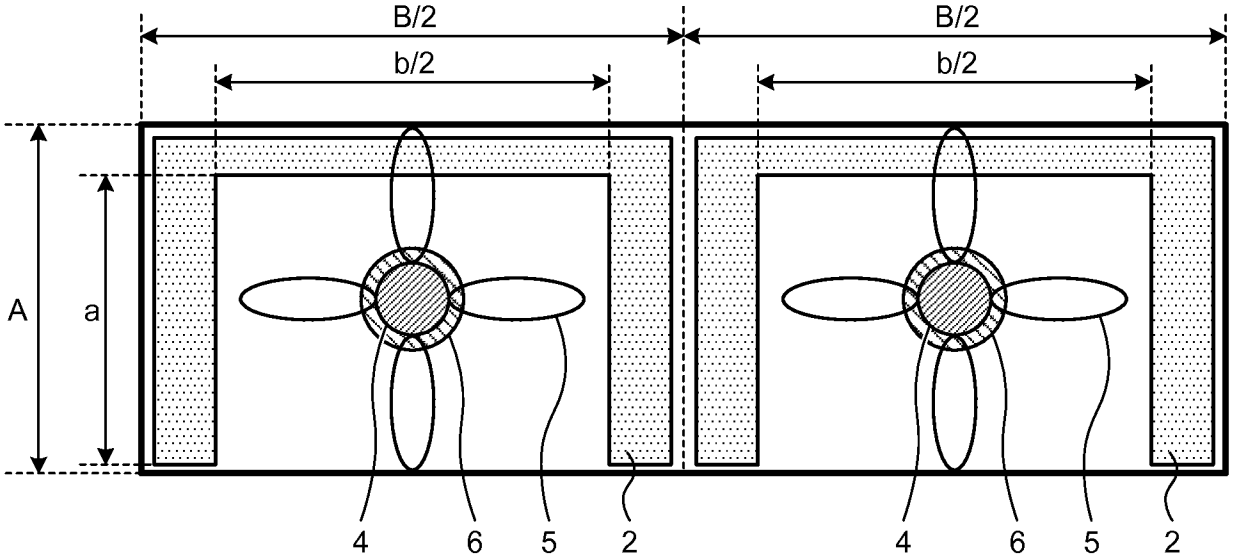
FIG. 8 is an explanatory diagram of a relation between an inner cross-sectional area of a casing or a heat exchanger and a cross-sectional area of a fan motor when n (n is an integer of 2 or more) motors are used.

FIG. 8 is an explanatory diagram of a relation between the inner sectional area of the casing or the heat exchanger 2 and the sectional area of the fan motor when n (n is an integer of 2 or more) motors are used. In the outdoor unit 1 shown in FIG. 8, two fan motors 6 are installed, and the heat exchanger 2 is installed so as to surround each of the fan motors 6. The outdoor unit 1 in which two fan motors 6 are installed is shown in FIG. 8 for simplifying the explanations. However, the number n of the fan motors 6 installed in one outdoor unit 1 is not limited to the example shown in FIG. 8 and three or more fan motors can be installed.

When two fan motors 6 are installed as shown in FIG. 8, a value obtained by dividing the value of B (the longitudinal external dimension of the side of the casing 13) by the number n of the fan motors 6 (B/2 in the example shown in FIG. 8) is used in the above Expression (2). That is, when a plurality of fan motors 6 are used and arranged along the other side surface of the heat exchanger 2, a value obtained by dividing the external dimension B by the number (n) of the fan motors 6 arranged along the other side surface of the casing 13 is used as the external dimension B of the other side.

A value obtained by dividing the value of b (the longitudinal internal dimension of the side of the heat exchanger 2) by the number n of the fan motors 6 (b/2 in the example shown in FIG. 8) is used in the above Expression (3). That is, when a plurality of fan motors 6 are used and arranged along the other side surface of the heat exchanger 2, the heat exchanger 2 is sectioned into plural numbers so as to be arranged in the direction in which the respective fan motors 6 are arranged, and a value obtained by dividing the internal dimension b by the number (n) of the fan motors 6 arranged along the other side surface of the heat exchanger is used for the internal dimension b of the other side.

As described above, the air conditioner outdoor unit according to the present embodiment includes the casing 13 having the air inlet 15 on the side surfaces and the air outlet 14 on the upper surface, the heat exchanger 2 that covers the air inlet 15 and is provided inside the casing 13, the fan 3 that sucks in air from the air inlet 15 and discharges air from the air outlet 14, and the fan motor (6, 6-1) provided on the lower side of the fan 3. The fan motor is set such that the outer diameter D1 is larger than the outer diameter D2 of the fan boss 4, and the outer periphery is positioned closer to the center side of the fan motor than the straight line c passing the upper side (for example, the predetermined position a, a') of the height center of the heat exchanger 2 and the side of the fan boss 4 (for example, the predetermined position b). Therefore, the outer diameter D1 of the fan motor becomes the size that can reduce the ratio of the iron loss to the copper loss and has a little influence on the wind passage. Accordingly, the motor efficiency can be improved without reducing the heat exchange amount. As a result, energy consumption can be reduced as compared to the conventional air conditioner outdoor unit having an equivalent air conditioning capacity, and an air conditioner outdoor unit favorable from the viewpoint of LCA (Life Cycle Assessment) can be provided.

When it is assumed that the position on the heat exchanger away from the upper end of the heat exchanger 2 by the length corresponding to one-third of the height of the heat exchanger 2 is a, and the arbitrary position on the side of the fan boss 4 is b, the fan motor (6, 6-1) according to the present embodiment is set such that the outer diameter D1 thereof is larger than the outer diameter D2 of the fan boss 4, and the outer periphery thereof is positioned closer to the center side of the fan motor than the straight line c passing the a and the b. Accordingly, as described above, the motor efficiency can be improved without reducing the heat exchange amount.

When it is assumed that the position on the heat exchanger away from the upper end of the heat exchanger 2 by the length corresponding to one-third of the height of the heat exchanger 2 is a, and the arbitrary position on the side of the fan boss 4 is b, the fan motor (6, 6-1) according to the present embodiment is set such that the outer diameter D1 thereof is larger than a value corresponding to 95% of the outer diameter D2 of the fan boss 4, and the outer periphery thereof is positioned closer to the center side of the fan motor than the straight line c passing the a and the b. Accordingly, as described above, the motor efficiency can be improved without reducing the heat exchange amount.

As described above, the air conditioner outdoor unit according to the embodiment of the present invention is only an example of the contents of the present invention and can be combined with other well-known techniques. It is needless to mention that the present invention can be configured while modifying it without departing from the scope of the invention, such as omitting a part the configuration.

INDUSTRIAL APPLICABILITY

As explained above, the present invention is applicable mainly to a top flow-type air conditioner outdoor unit, and is particularly useful in improving the motor efficiency without decreasing the heat exchange amount.

The invention claimed is:

1. An air conditioner outdoor unit comprising:

a casing having an air inlet on a side surface and an air outlet on an upper surface;

a heat exchanger that covers the air inlet and is provided inside the casing;

a fan that sucks in air from the air inlet and discharges air from the air outlet; and a fan motor provided on a lower side of the fan, wherein when an outer diameter of the fan motor is D1, an outer diameter of a boss of the fan is D2, an external dimension of one side of the casing is A, an external dimension of an other side orthogonal to the one side of the casing is B, an internal dimension of one side of the heat exchanger is a, and an internal dimension of an other side orthogonal to the one side of the heat exchanger is b, the fan motor is formed so as to satisfy $D2 \leq D1$, and also satisfy $(D1)^2\pi/4 < A \times B \times 0.12$ or $(D1)^2\pi/4 < a \times b \times 0.2$.

2. The air conditioner outdoor unit according to claim 1, wherein when the fan motor is used in plural, and these fan motors are arranged along the other side of the heat exchanger, a value obtained by dividing the external dimension B of the other side of the casing by the number of fan motors arranged along the other side is used for the external dimension B.

3. The air conditioner outdoor unit according to claim 1, wherein when the fan motor is used in plural and these fan motors are arranged along the other side of the heat exchanger, the heat exchanger is sectioned into plural numbers so as to be arranged in a direction in which the respective fan motors are arranged, and a value obtained by dividing the internal dimension b of the other side of the heat exchanger by the number of fan motors arranged along the other side is used for the internal dimension b.

4. An air conditioner outdoor unit comprising:

a casing having an air inlet on a side surface and an air outlet on an upper surface;

a heat exchanger that covers the air inlet and is provided inside the casing;

a fan that sucks in air from the air inlet and discharges air from the air outlet; and a fan motor provided on a lower side of the fan, wherein the fan motor is set such that an outer diameter of the fan motor is larger than an outer diameter of a boss of the fan, and an outer periphery of the fan motor is positioned closer to a center side of the fan motor than a straight line passing an upper side of a height center of the heat exchanger and a side of the boss.

5. An air conditioner outdoor unit comprising:

a casing having an air inlet on a side surface and an air outlet on an upper surface;

a heat exchanger that covers the air inlet and is provided inside the casing;

a fan that sucks in air from the air inlet and discharges air from the air outlet; and a fan motor provided on a lower side of the fan, wherein assuming that a position on the heat exchanger away from an upper end of the heat exchanger by a length corresponding to one-third of a height of the heat exchanger is a, and an arbitrary position on a side of a boss of the fan is b, the fan motor is set such that an outer diameter of the fan motor is larger than an outer diameter of the boss, and an outer periphery of the fan motor is positioned closer to a center side of the fan motor than a straight line passing through the a and the b.

6. An air conditioner outdoor unit comprising:

a casing having an air inlet on a side surface and an air outlet on an upper surface;

a heat exchanger that covers the air inlet and is provided inside the casing;

a fan that sucks in air from the air inlet and discharges air from the air outlet; and a fan motor provided on a lower side of the fan, wherein assuming that a position on the heat exchanger away from an upper end of the heat exchanger by a length corresponding to one-third of a height of the heat exchanger is a, and an arbitrary position on a side of a boss of the fan is b, the fan motor is set such that an outer diameter of the fan motor is larger than a value corresponding to 95% of an outer diameter of the boss, and an outer periphery of the fan motor is positioned closer to a center side of the fan motor than a straight line passing through the a and the b.

7. The air conditioner outdoor unit according to claim 1, wherein the fan motor is configured such that a relation between an outer diameter D1 and an axial height H2 of the fan motor becomes $D1 > H2$.

8. The air conditioner outdoor unit according to claim 4, wherein the fan motor is provided on an upper side of fitting legs installed inside the casing, and the outer diameter of the fan motor decreases as going from a surface on a side of the fitting leg toward a surface on a side of the fan.

9. The air conditioner outdoor unit according to claim 4, further comprising a plurality of heat dissipators formed on the outer periphery of the fan motor and protruding outward of the fan motor, wherein the fan motor is set such that the outer diameter of the fan motor excluding the heat dissipators is larger than the outer diameter of the boss, and the outer periphery of the fan motor is positioned closer to the center side of the fan motor than the straight line passing through the a and the b.

10. The air conditioner outdoor unit according to claim 1, wherein the fan motor is configured such that a relation between a copper loss and an iron loss at the time of a rated operation becomes "the copper loss >the iron loss".

11. The air conditioner outdoor unit according to claim 1, wherein the fan motor is configured such that a relation between a copper loss and an iron loss at the time of a rated operation becomes "the copper loss >2×the iron loss".

12. The air conditioner outdoor unit according to claim 1, wherein the fan motor is of an inner-rotor type.

13. The air conditioner outdoor unit according to claim 1, wherein the fan motor is of an outer-rotor type.

14. The air conditioner outdoor unit according to claim 1, wherein the fan motor is of a double-rotor type in which rotors are present on an inner peripheral side and an outer peripheral side of a stator.

15. The air conditioner outdoor unit according to claim 4, wherein the fan motor is configured such that a relation between an outer diameter D1 and an axial height H2 of the fan motor becomes $D1 > H2$.

16. The air conditioner outdoor unit according to claim 5, wherein the fan motor is configured such that a relation between an outer diameter D1 and an axial height H2 of the fan motor becomes $D1 > H2$.

17. The air conditioner outdoor unit according to claim 6, wherein the fan motor is configured such that a relation between an outer diameter D1 and an axial height H2 of the fan motor becomes $D1 > H2$.

18. The air conditioner outdoor unit according to claim 5, wherein the fan motor is provided on an upper side of fitting legs installed inside the casing, and the outer diameter of the fan motor decreases as going from a surface on a side of the fitting leg toward a surface on a side of the fan.

19. The air conditioner outdoor unit according to claim 6, wherein the fan motor is provided on an upper side of fitting legs installed inside the casing, and the outer diameter of the fan motor decreases as going from a surface on a side of the fitting leg toward a surface on a side of the fan.

20. The air conditioner outdoor unit according to claim 5, further comprising a plurality of heat dissipators formed on the outer periphery of the fan motor and protruding outward of the fan motor, wherein the fan motor is set such that the outer diameter of the fan motor excluding the heat dissipators is larger than the outer diameter of the boss, and the outer periphery of the fan motor is positioned closer to the center side of the fan motor than the straight line passing through the a and the b.

21. The air conditioner outdoor unit according to claim 6, further comprising a plurality of heat dissipators formed on the outer periphery of the fan motor and protruding outward of the fan motor, wherein the fan motor is set such that the outer diameter of the fan motor excluding the heat dissipators is larger than the outer diameter of the boss, and the outer periphery of the fan motor is positioned closer to the center side of the fan motor than the straight line passing through the a and the b.

22. The air conditioner outdoor unit according to claim 4, wherein the fan motor is configured such that a relation between a copper loss and an iron loss at the time of a rated operation becomes "the copper loss >the iron loss".

23. The air conditioner outdoor unit according to claim 5, wherein the fan motor is configured such that a relation between a copper loss and an iron loss at the time of a rated operation becomes "the copper loss >the iron loss".

24. The air conditioner outdoor unit according to claim 6, wherein the fan motor is configured such that a relation between a copper loss and an iron loss at the time of a rated operation becomes "the copper loss >the iron loss".

25. The air conditioner outdoor unit according to claim 4, wherein the fan motor is configured such that a relation between a copper loss and an iron loss at the time of a rated operation becomes "the copper loss >2×the iron loss".

26. The air conditioner outdoor unit according to claim 5, wherein the fan motor is configured such that a relation between a copper loss and an iron loss at the time of a rated operation becomes "the copper loss >2×the iron loss".

27. The air conditioner outdoor unit according to claim 6, wherein the fan motor is configured such that a relation between a copper loss and an iron loss at the time of a rated operation becomes "the copper loss >2×the iron loss".

28. The air conditioner outdoor unit according to claim 4, wherein the fan motor is of an inner-rotor type.

29. The air conditioner outdoor unit according to claim 5, wherein the fan motor is of an inner-rotor type.

30. The air conditioner outdoor unit according to claim 6, wherein the fan motor is of an inner-rotor type.

31. The air conditioner outdoor unit according to claim 4, wherein the fan motor is of an outer-rotor type.

32. The air conditioner outdoor unit according to claim 5, wherein the fan motor is of an outer-rotor type.

33. The air conditioner outdoor unit according to claim 6, wherein the fan motor is of an outer-rotor type.

34. The air conditioner outdoor unit according to claim 4, wherein the fan motor is of a double-rotor type in which rotors are present on an inner peripheral side and an outer peripheral side of a stator.

35. The air conditioner outdoor unit according to claim 5, wherein the fan motor is of a double-rotor type in which rotors are present on an inner peripheral side and an outer peripheral side of a stator.

36. The air conditioner outdoor unit according to claim 6, wherein the fan motor is of a double-rotor type in which rotors are present on an inner peripheral side and an outer peripheral side of a stator.

* * * * *